US006343942B1

(12) United States Patent
Okamoto

(10) Patent No.: US 6,343,942 B1
(45) Date of Patent: Feb. 5, 2002

(54) CONNECTION CONFIGURATION OF A MULTIPLE-LIGHT LIGHTING FIXTURE

(75) Inventor: Masaki Okamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/421,318

(22) Filed: Oct. 18, 1999

(30) Foreign Application Priority Data

Oct. 26, 1998 (JP) ..... 10-303680

(51) Int. Cl.[7] ..... H01R 25/00

(52) U.S. Cl. ..... 439/110; 439/56; 439/419; 439/699.1; 439/699.2

(58) Field of Search ..... 439/110, 699.1, 439/699.2, 602, 619, 419, 375, 56, 57

(56) References Cited

U.S. PATENT DOCUMENTS 4,047,018 A * 9/1977 Harris ..... 439/56
4,213,665 A * 7/1980 Murray et al. ..... 439/56
5,529,535 A * 6/1996 Forish ..... 436/699.2
5,672,000 A 9/1997 Lin
5,797,766 A * 8/1998 Tanigawa ..... 439/419
5,823,816 A * 10/1998 Uchida et al. ..... 439/419
6,086,408 A * 7/2000 Tanigawa ..... 439/419
6,139,334 A * 10/2000 Florish et al. ..... 439/56

FOREIGN PATENT DOCUMENTS

DE 3416143 A1 11/1985
DE 295 09 699 10/1996
JP 62-145846 9/1987

OTHER PUBLICATIONS

European Search Report EP 99 30 7196 dated Apr. 24, 2001.

* cited by examiner

*Primary Examiner*—Tho D. Ta
(74) *Attorney, Agent, or Firm*—Banner & Witcoff, Ltd.

(57) ABSTRACT

Electric wires 41 are housed within a housing space 36 and make contact with bulb-inking contacting members 22, all of the bulbs 42 being connected via bulb terminal fittings 19 and bulb-linking contacting members 22. A multiple-light lighting fixture can be made suitable for a varying number of bulbs or for bulbs of varying pitch merely by altering the length of the electric wires 41. As a result costs can be reduced compared to the case in which a bus bar is formed in a unified manner with terminal areas which make contact with bulbs, and in which a plurality of types of bus bars are produced in order to correspond to the number of bulbs or the pitch thereof.

13 Claims, 19 Drawing Sheets

CONNECTION CONFIGURATION OF A MULTIPLE-LIGHT LIGHTING FIXTURE

TECHNICAL FIELD

The present invention relates to a connection configuration of a multiple-light lighting fixture.

BACKGROUND OF THE INVENTION

A conventional lighting means provided on a door of an automobile for illuminating the outside of the automobile is disclosed in the Laid-Open Publication JP-62-145846. As shown in FIG. 22 of this specification, a plurality of bulbs b are aligned in a single row in an oblong lamp holder a, the bulbs b being attached thereto. Contact points on the feed side of this plurality of bulbs b are attached to one another, as are contact points on the earth side. In this manner, two connecting circuits are formed which are connected by a connector member c formed on the lamp holder a, a corresponding connector d of a harness circuit on the battery side being connected to the connector member c.

Two long and narrow bus bars e and f provided along the array of bulbs b serve as means to connect the feed side contact points with one another, and to connect the earth side contact points with one another. The first bus bar e is provided with a plurality of terminal areas g which make contact with the feed side contact points of the bulbs b, and the second bus bar f is provided with a plurality of terminal areas h which makes contact with the earth side contact points of the bulbs b. Moreover, a pair of terminal areas i are provided on the two bus bars e and f, these terminal areas i comprising the connector member c.

In this type of multiple-light lighting fixture, a plurality of types of lighting fixtures are produced which have varying numbers of bulbs b and varying orientation pitches of the bulbs b so as to correspond to the width of the door and the required intensity of lighting, etc. depending on the type of automobile. However, in the conventional example described above, the single bus bar e or f is formed in a unified manner and the plurality of terminal areas g and h thereof each correspond with a bulb b. As a result, if the number of bulbs or the orientation pitch thereof varies, a plurality of bus bars e and f must be produced to suit this number and pitch and, consequently, cost increases.

SUMMARY OF THE INVENTION

According to the invention there is provided a multiple lamp fixture for receiving a plurality of aligned lamp bulbs, and having an electrical connector, the lamp fixture comprising a lamp holder, plurality of attachment members on the lamp holder, a plurality of electrically conductive terminal fittings associated with each of said attachment members, and having respective contacts, each of said terminal fittings also having a linking contact for connection to a respective electrical conductor of said connector. Preferably the linking contacts comprise a resilient arm which may also serve to retain each terminal fitting by engagement in a recess of the fixture.

BRIEF DESCRIPTION OF DRAWINGS

Other features of the invention will be apparent from the following description of any preferred embodiments shown by way of examples only in the accompanying drawings in which.

DESCRIPTION OF PREFERRED EMBODIMENTS

Figure 1:
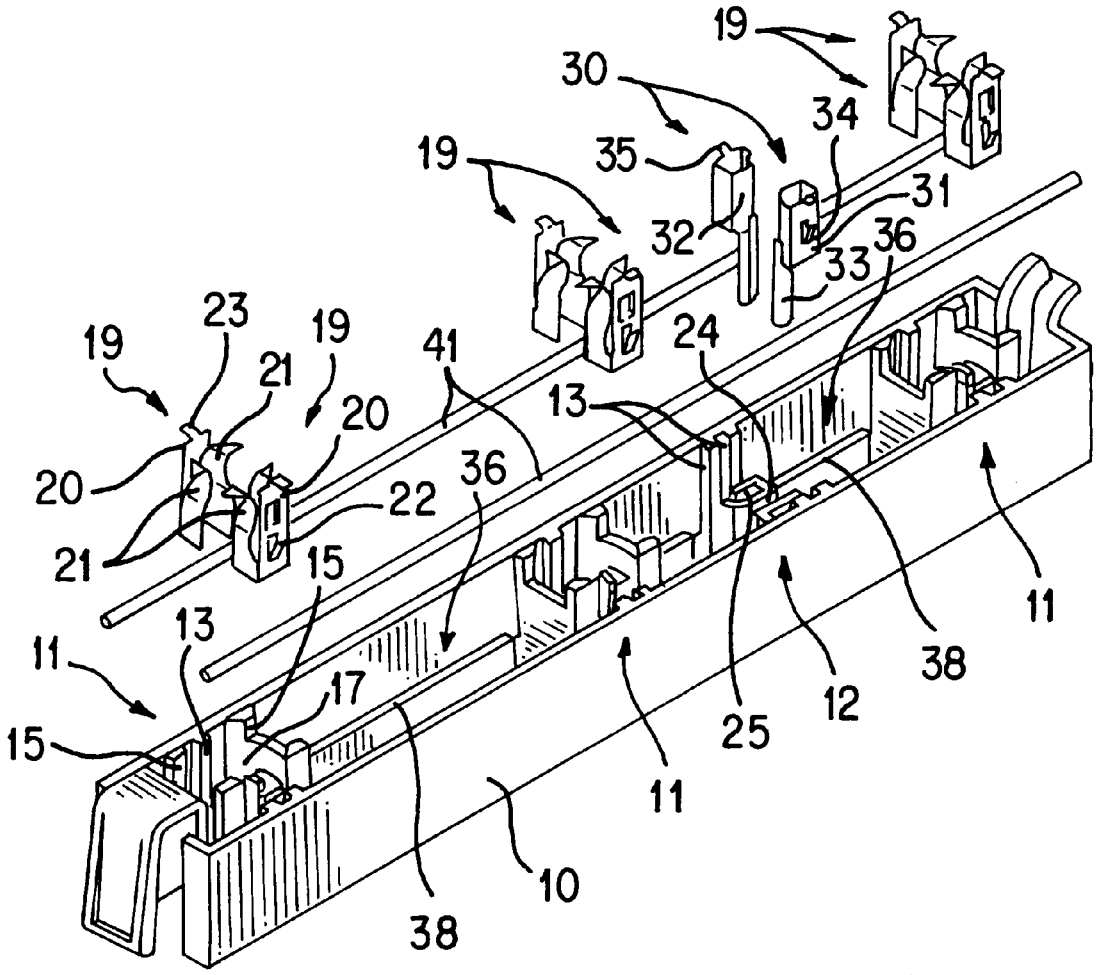
FIG. 1 is a disassembled diagonal view of a first embodiment.
Figure 2:
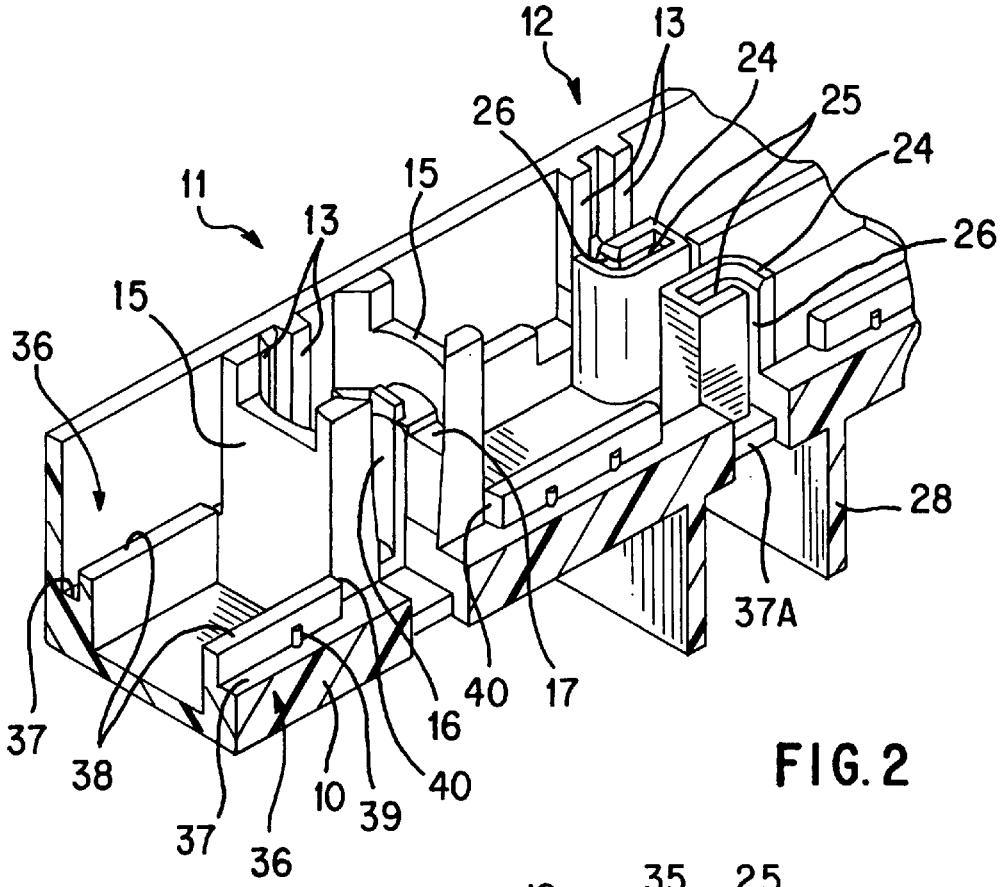
FIG. 2 is a partially cut-away diagonal view of a lamp holder.
Figure 3:
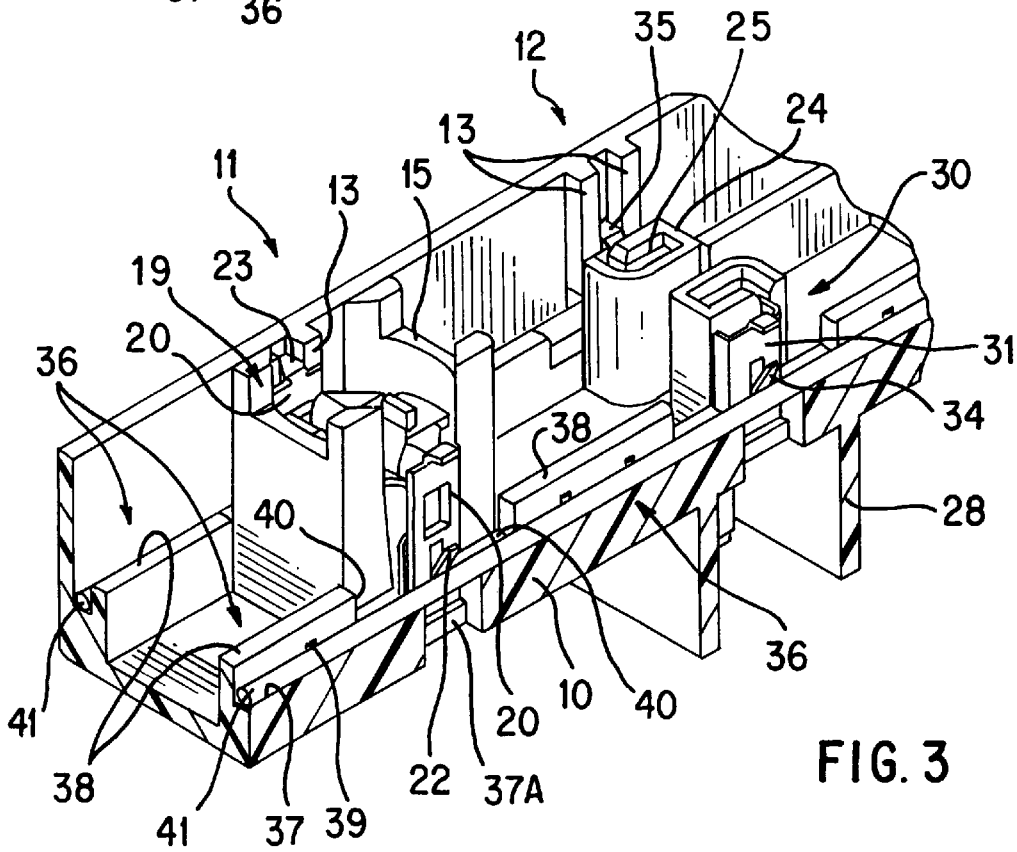
FIG. 3 is a partially cut-away diagonal view of the lamp holder with terminal fittings in an attached state therein.
Figure 4:
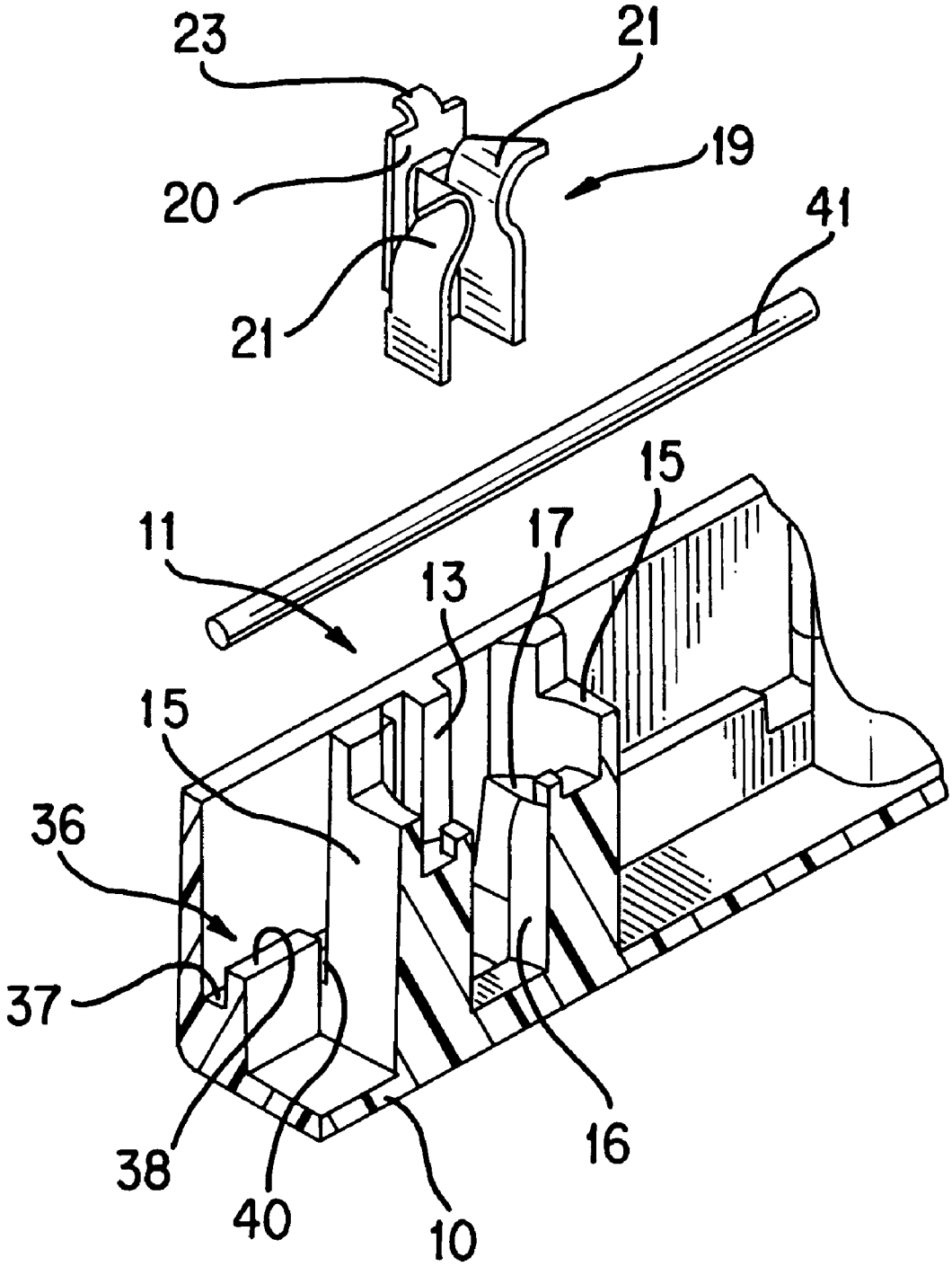
FIG. 4 is a partially cut-away diagonal view showing a separated state of a terminal fitting attachment member and a bulb terminal fitting.
Figure 5:
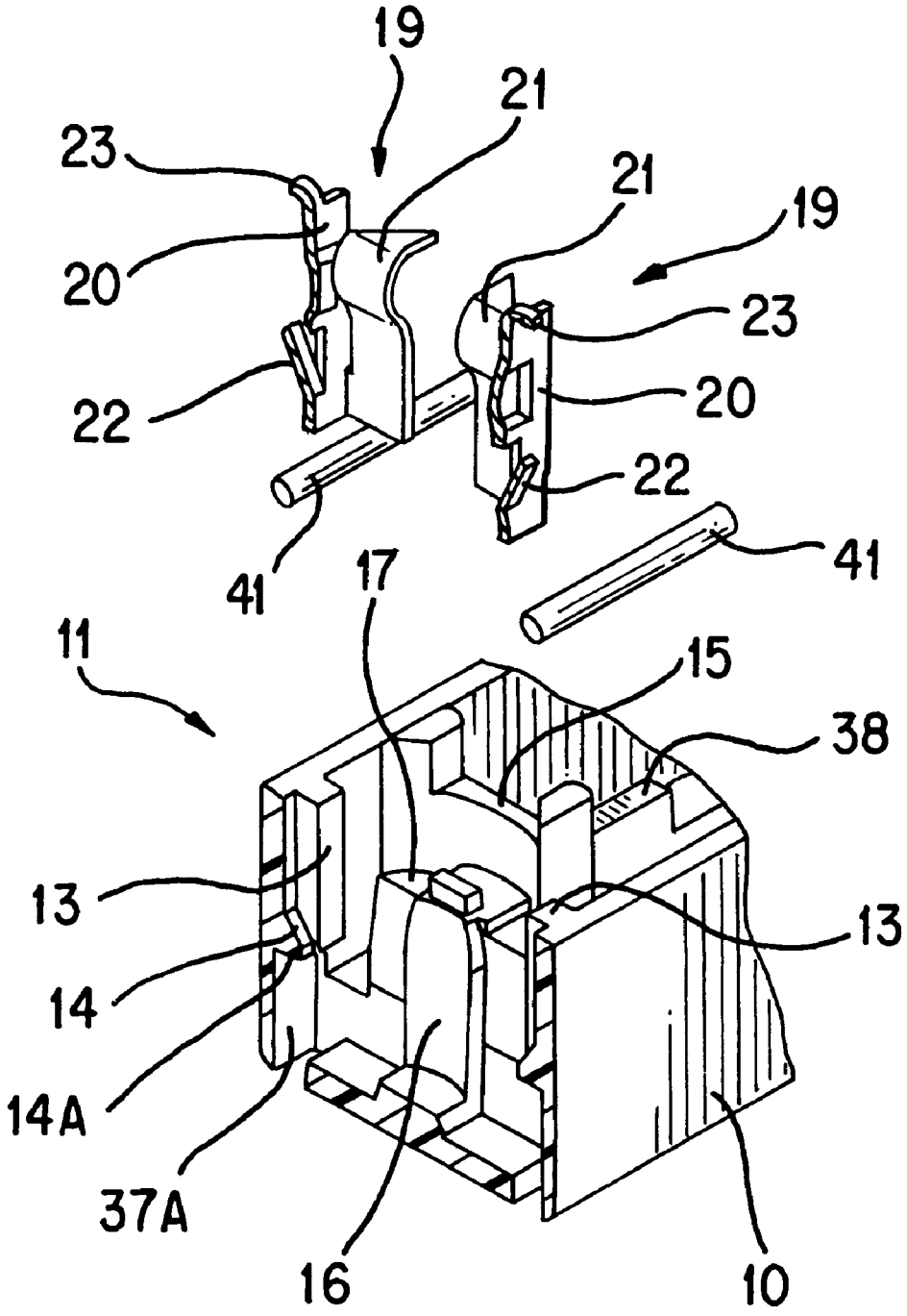
FIG. 5 is a partially cut-away diagonal view showing the separated state of the terminal fitting attachment member and the bulb terminal fitting.
Figure 6:
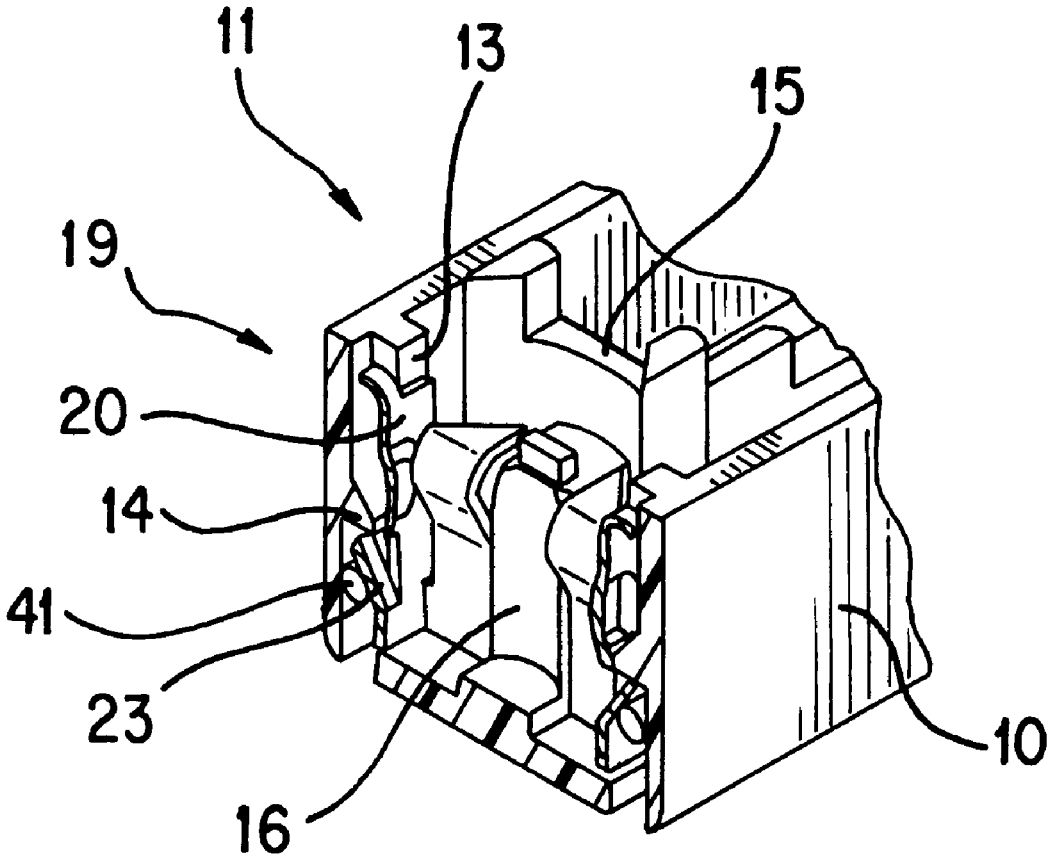
FIG. 6 is a partially cut-away diagonal view showing the bulb terminal fitting in an attached state with the terminal fitting attachment member.
Figure 7:
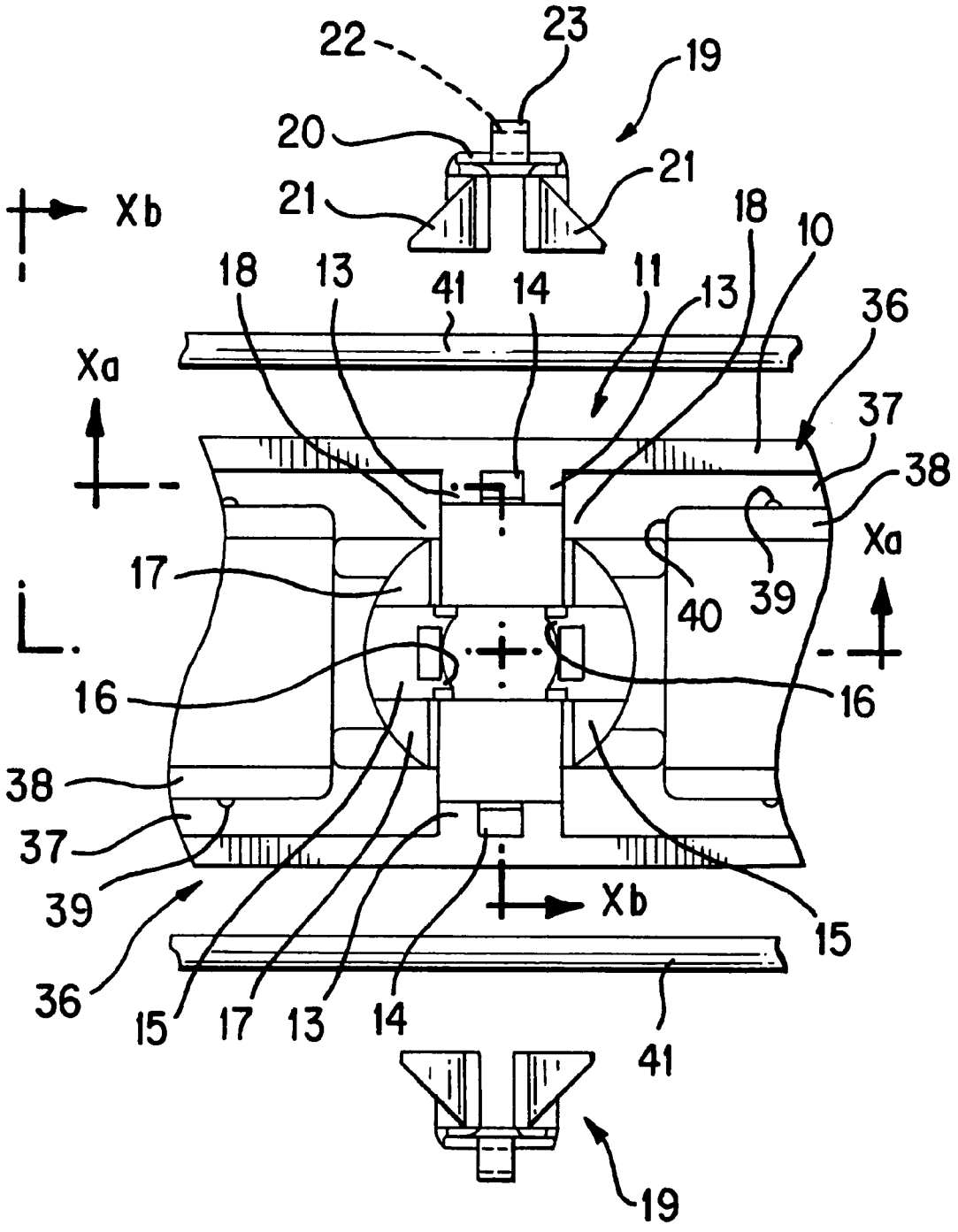
FIG. 7 is a plan view showing the terminal fitting attachment member and the bulb terminal fitting in a separated state.
Figure 8:
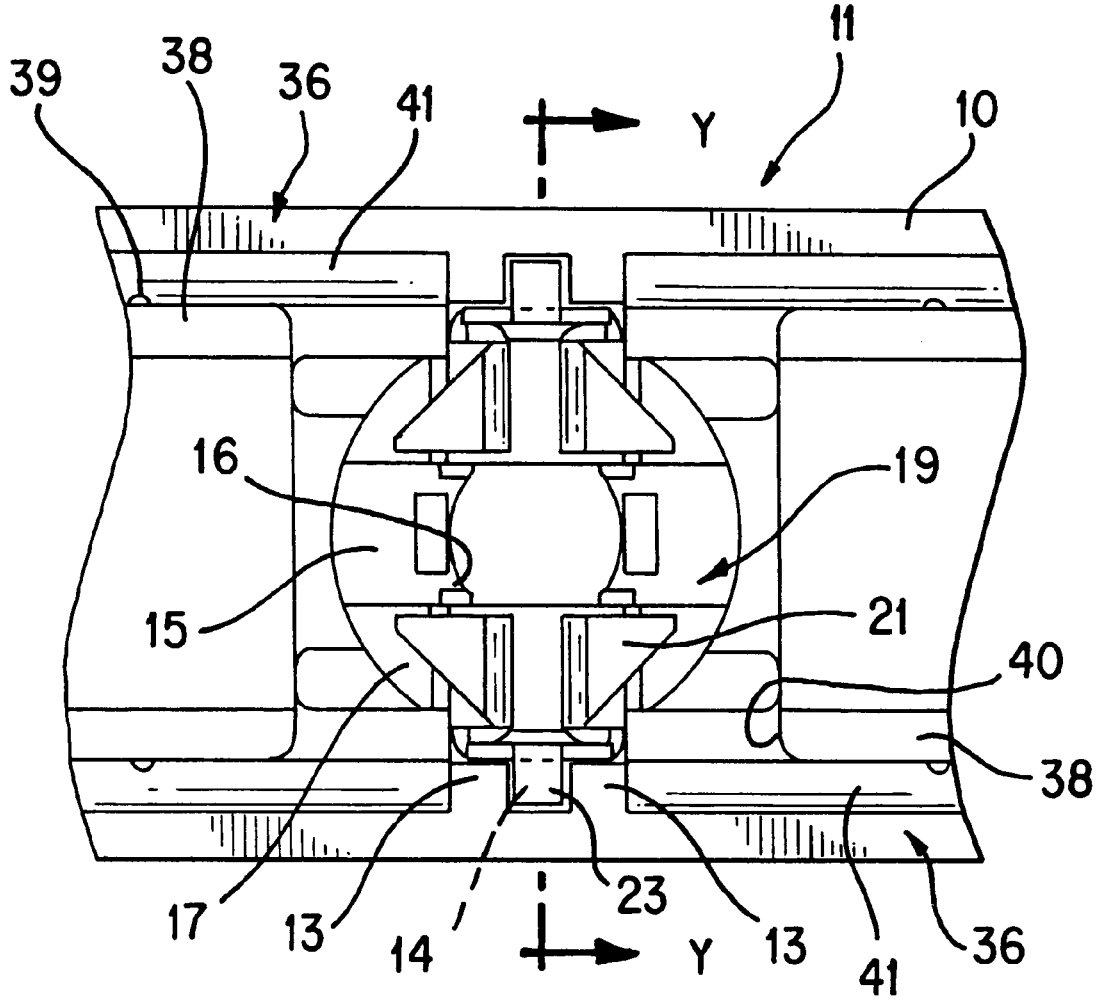
FIG. 8 is a plan view showing the bulb terminal fitting in an attached state with the terminal fitting attachment member.
Figure 9:
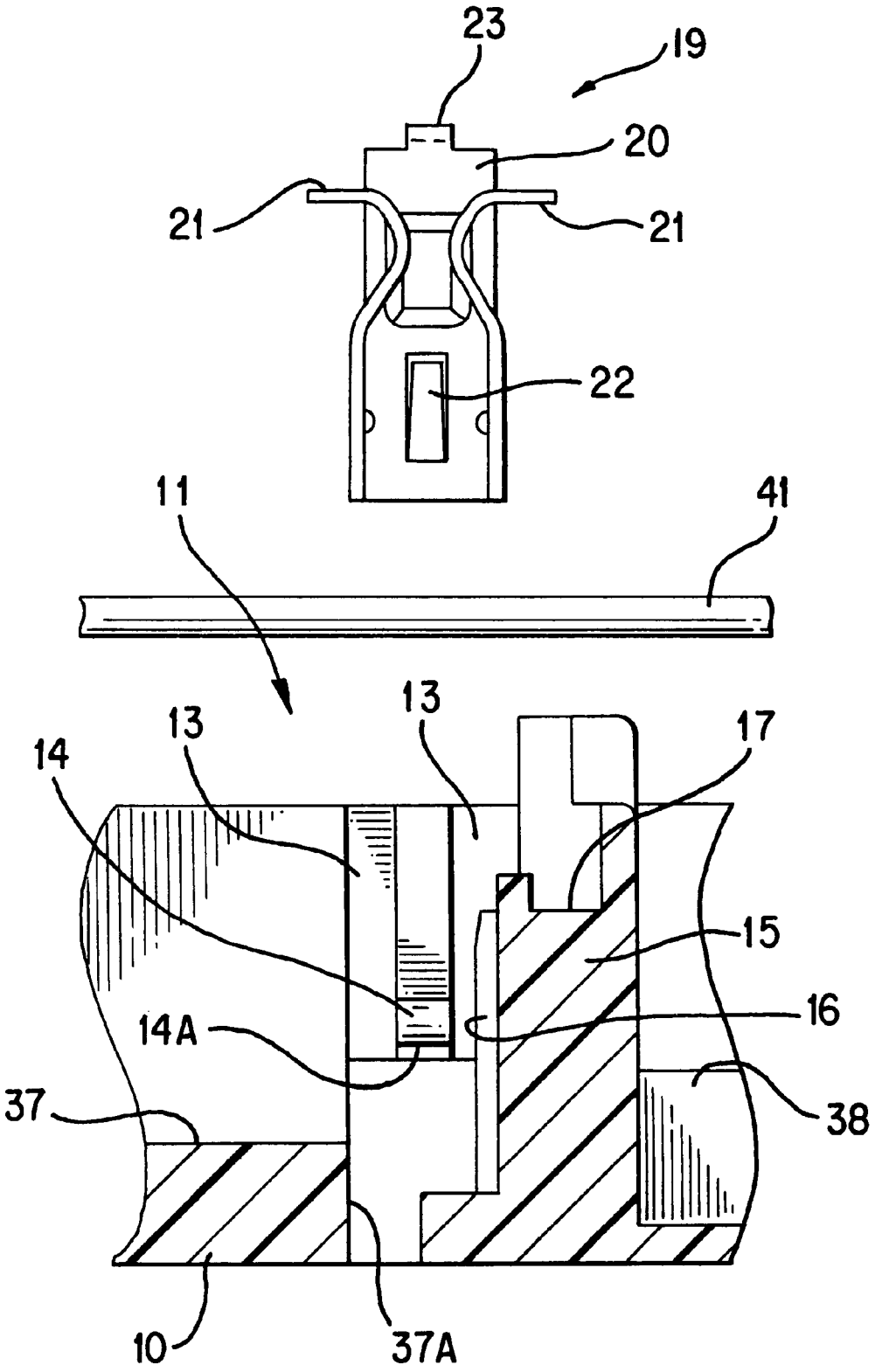
FIG. 9 is a cross-sectional view of FIG. 7 along the line Xa—Xa.
Figure 10:
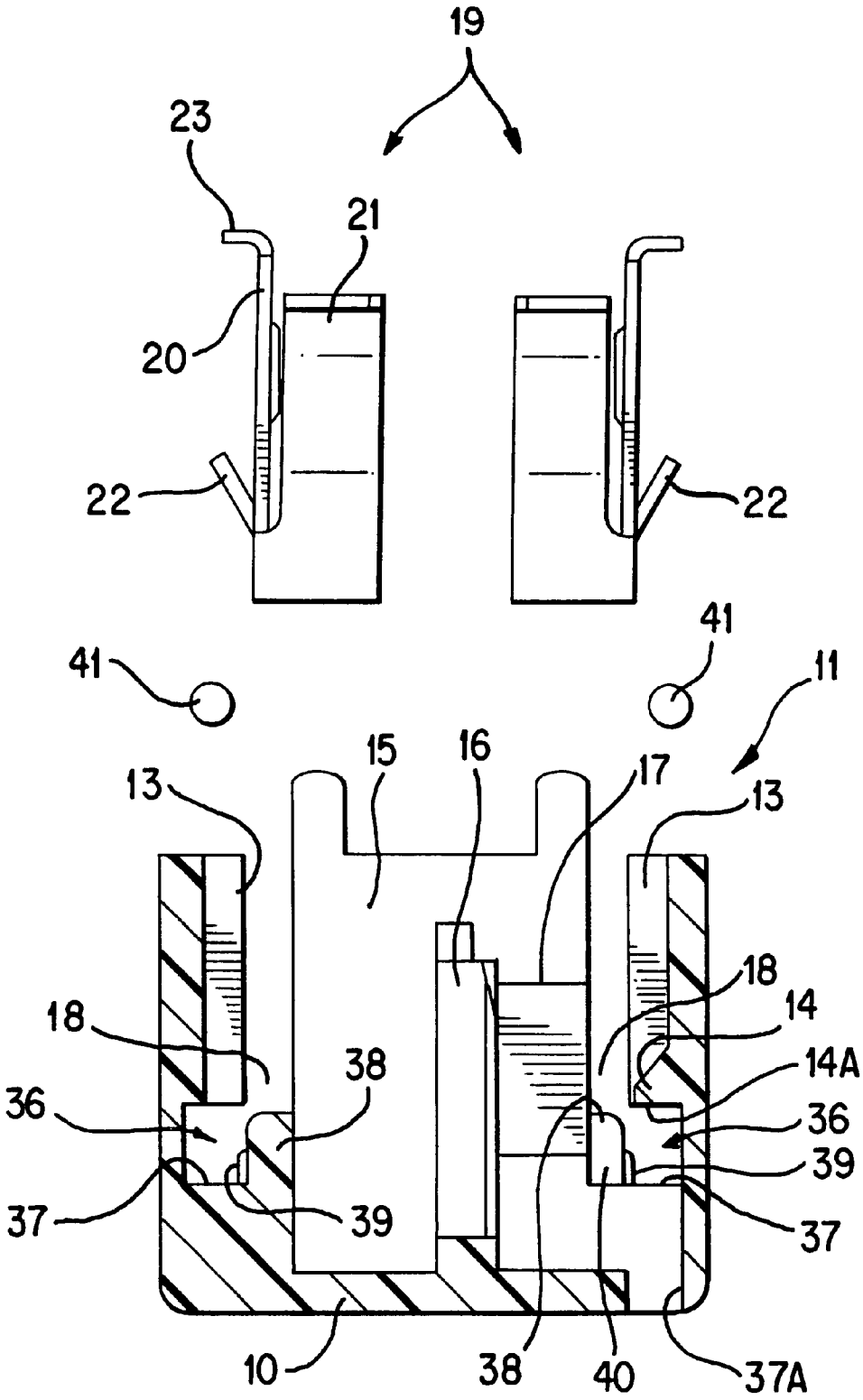
FIG. 10 is a cross-sectional view of FIG. 7 along the line Xb—Xb.

A first embodiment of the present invention is explained below with the aid of FIGS. 1 to 17.

A multiple-light fixture of the present embodiment comprises a lamp holder 10, bulbs 42, bulb terminal fittings 19, connector terminal fittings 30 and electric wires 41. The lamp holder 10 has a long and narrow box shape facing in a left-right direction, and an entire upper face thereof is open. Terminal fitting attachment members 11 are provided thereon in a length-wise direction, these terminal fitting attachment members 11 being provided at three locations separated by a prescribed pitch, and a connector member 12 is provided thereon at a single location.

The terminal fitting attachment members 11 will now be explained. A pair of left and right ribs 13 is formed on both anterior and posterior inner wall faces of the lamp holder 10, these ribs extending in an up-down direction from an upper edge of a mid-height. Stopping protrusions 14 are provided on the lower end of the ribs 13. The upper face of each stopping protrusion 14 is a diagonal guiding face, and the lower face thereof is a horizontal stopping face 14A. The stopping faces 14A retain the bulb terminal fittings 19. A pair of left and right protrusions 15 protrude from base faces of the terminal fitting attachment members 11, and an attaching member 16 is formed in the centre of mutually facing inner faces of the protrusion 15. This attachment member 16 extends to a specified height from the base face, and the inner side thereof protrudes slightly. The upper portions of inner faces of the protrusions 15 are cut away in a stepped shape and form recessed members 17.

A space is thus formed on the terminal fitting attachment members 11. This space is surrounded by inner walls of the lamp holder 10 and by the protrusions 15, and is open in an upwards direction, a wedge-base member 43 of the bulb 42 being inserted into this space. Further, an opening 18 is formed in the space between anterior and posterior ends of the protrusions 15 and the inner wall faces of the lamp holder 10, this opening 18 being for a housing space 36 which houses the electric wires 41.

Two bulb terminal fittings 19 are inserted from above into each of the terminal fitting attachment members 11 along inner wall faces of the lamp holder 10 and the inner wall faces of the protrusions 15. The bulb terminal fittings 19 are produced by bending punched electrically conductive sheet metal which has been pressed into a prescribed shape, each bulb terminal fitting 19 consisting of a supporting plate member 20 which extends in an up-down direction, and a left and right pair of resiliently bendable bulb joining members 21. These bulb joining members 21 connect with the supporting plate member 20 at the lower left and right edges of this supporting plate member 20. The upper half of each bulb joining member 21 is bent inwards into a hook shape, and the upper end thereof is bent so as to face horizontally outwards. Further, the upper edge of the supporting plate member 20 has a guiding protrusion 23 bent outwards at a right angle.

A portion of the lower end of the supporting plate member 20 is cut into, forming a resiliently bendable bulb-linking contacting member 22 which protrudes diagonally upwards and outwards in a cantilevered shape. This bulb-linking contacting member 22 makes contact in a resilient manner with the electric wires 41 which connect the bulbs 42. Furthermore, the diagonally upwards and outwards protruding cantilevered shape of the bulb-linking contacting member 22 means that, relative to the direction of insertion, when the bulb terminal fittings 19 are inserted into the terminal fitting attachment members 11, they have a diagonally open shape facing from the anterior to the posterior, and this shape therefore has the function of retaining the bulb terminal fittings 19 inside the terminal fitting attachment members 11.

When the bulb terminal fittings 19 are inserted into the terminal fitting attachment members 11 from above, the supporting plate member 20 extends along the inner faces of the ribs 13, the lower end of the bulb joining members 21 extends along the inner faces of the protrusions 15, and the side edges of the bulb joining members 21 make contact with and slide along the attaching member 16. Moreover, the guiding protrusion 23 fits between the two ribs 13 and thereby prevents any inclination to the left or right. After the bulb terminal fittings 19 have been inserted, the lower edges thereof make contact with the base face of the terminal fitting attachment members 11, thereby regulating further insertion. The bulb terminal fittings 19 thus reach a correct attaching state. As insertion is taking place, the bulb-linking contacting member 22 fits with the inner side face of the stopping protrusion 14 and consequently bends resiliently in the direction of engagement. Then, when each bulb terminal fitting 19 has been inserted to the correct attaching position, the bulb-linking contacting member 22 is released from the inner side face of the stopping protrusion 14 and returns resiliently to its original position, the tip (the posterior end in the direction of insertion) of the bulb-linking contacting member 22 fits with the lower stopping face 14A of the stopping protrusion 14, thereby regulating the movement of the bulb terminal fitting 19 in the direction of removal (upwards). In this manner, the bulb terminal fittings 19 are joined to the terminal fitting attachment members 11 (see FIGS. 6, 8 and 11).

One of the two bulb terminal fittings 19 within each terminal fitting attachment member 11 has the function of acting as a feed contact and the other has the function of acting as an earth contact. When the bulb terminal fittings 19 are in a joined state, the horizontally outwards facing upper ends of the bulb joining members 21 are attached in a manner so that the wedge-base members 43 can be inserted between the two bulb joining members 21 and connecting members 44 of the bulbs 42 make contact with the bulb joining members 21.

Next, the connector member 12 is explained. In the same manner as the terminal fitting attachment members 11, a pair of left and right ribs 13 are formed on the inner wall faces of the lamp holder 10, and stopping protrusions 14 identical with those of the terminal fitting attachment members 11 are provided between the ribs 13. A pair of anterior and posterior supporting members 24 protrude upwards from the base face. Insertion spaces 25, which are L-shaped when seen from above, are formed in the supporting members 24, and upper faces of these insertion spaces 25 are open. Slits 26 are formed in the face opposite to the lamp holder 10 located in the supporting members 24, these slits 26 passing through to the insertion spaces 25. Further, a through hole 27 is formed in the base face of each insertion space 25, this through hole 27 passing through to the lower face side of the lamp holder 10. Fitting members 28 connected to the through hole 27 are formed at the lower face of the lamp holder 10, these fitting members 28 being of an angular tubular shape and open on their lower face. These fitting members 28 fit with a corresponding connector (not shown). Further, an opening 29 is formed in the space between the supporting members 24 and the ribs 13, this opening 29 being for a housing space 36 to house the electric wires 41 (to be explained later).

Two connector terminal fittings 30 for connecting to the corresponding connector are inserted from above into the connector member 12 and are attached thereto. The connector terminal fittings 30 are produced by bending punched electrically conductive sheet metal which has been pressed into a prescribed shape, each connector terminal fitting 30 consisting of a supporting plate member 31 which extends in an up-down direction, L-shaped inserting members 32 connecting with one of the side edges of the supporting plate member 31, and tabs 33, which extend downwards from the lower edge of the inserting members 32. Further, the upper edge of supporting plate member 31 has a guiding protrusion 35 bent outwards at a right angle.

A portion of the lower end of the supporting plate member 31 is cut into, forming a resiliently bendable bulb-linking contacting member 34 which protrudes diagonally upwards and outwards in a cantilevered shape. This bulb-linking contacting member 34, like the bulb-linking contacting member 22 of the bulb terminal fittings, makes contact in a resilient manner with the electric wires 41 and has the function of retaining the connector terminal fittings 30 inside the connector member 12.

When the connector terminal fittings 30 are inserted into the connector member 12 from above, the supporting plate member 31 extends along the inner faces of the ribs 13, the tabs 33 pass through the holes 27 and the inserting members 32 fit with the insertion spaces 25. Further, the guiding protrusion 35 fits between the two ribs 13 and thereby prevents any inclination to the left or right. After the connector terminal fittings 30 have been inserted, the lower edges thereof make contact with the base face of the connector member 12, thereby regulating further insertion, and the connector terminal fittings 30 reach a correct attached state. As insertion is taking place, the bulb-linking contacting member 34 fits with the inner side face of the stopping protrusion 14 and consequently bends resiliently in the direction of stopping. Then, when each connector terminal fitting 30 has been inserted to the correct attaching position, the bulb-linking contacting member 34 is released from the inner side face of the stopping protrusion 14 and returns resiliently to its original position, the tip (the posterior end in the direction of insertion) of the bulb-linking contacting member 34 fits with the lower face 14A of the stopping protrusion 14 and thereby regulates the movement of the connector terminal fitting 30 in a direction of removal (upwards). In this manner, the two connector terminal fittings 30 are joined to the connector member 12 (see FIGS. 13, 15 and 17). One of these connector terminal fittings 30 has the function of acting as a feed contact, the other has the function of acting as an earth contact. Further, the tabs 33 located close to the fitting members 28 of the two connector terminal fittings 30 are attached to terminal fittings of the corresponding connector.

The feed contacts of the bulb terminal fittings 19 and connector terminal fittings 30 described above are put in a connected state with one another, as are the earth contacts of the bulb terminal fittings 19 and connector terminal fittings 30. The connecting means consists of the housing space 36 formed in the lamp holder 10 and the electric wires 41 housed within this housing space 36. The electric wires 41 are bare electric wires, the outer circumference of which is not provided with a plastic cover. The wire may be formed by using a plurality of individual conducting wires, or by using a bare and cross-sectionally circular single wire.

The housing space 36 consists of a base wall face 37 which extends from the anterior inner wall face to the posterior inner wall face of the lamp holder 10, and side wall members 38 which protrude in an L-shape. The housing space 36 extends in a long and narrow shape facing in a left-right direction, in the direction of distribution of the bulbs 42. The housing space 36 extends between the ribs 13 of the neighbouring terminal fitting attachment members 11, as well as between the ribs 13 of the neighbouring terminal fitting attachment members 11 and the ribs 13 of the connector member 12. The base wall face 37 houses the electric wires 41 from below, and the height of the upper face of the base wall face 37 is lower than that of the lower end faces of the ribs 13. The protruding width of this base wall face 37 is identical with the protrusion of the ribs 13. The inner wall face of the lamp holder 10, and the space between the side wall members 38 corresponding therewith, are approximately identical to the inner diameter of the electric wires 41. Further, a plurality of chamfer protrusions 39 are formed on the inner faces of the side wall members 38, these facing in left and right directions and separated by an appropriate distance. Moreover, the area of the base wall face 37 directly below the ribs 13 is interrupted and open to the lower face of the lamp holder 10. These are spaces 37A for forming the stopping protrusions 14, and are formed in the minimum possible area of the base wall face 37. Furthermore, notches are made in the side wall members 38 in the vicinity of the ribs 13, these notched members 40 being spaced to allow the electric wires 41 to be housed under the ribs 13.

Next, the operation of the present embodiment is explained.

When attachment is to be performed, the two electric wires 41 are first inserted from above into the housing space 36 before the terminal fittings 19 and 30 are attached to the lamp holder 10. These electric wires 41 are cut so as to conform to the length of the housing space 36 in a left-right direction, the size of these electric wires 41 making it possible for them to be attached to the bulb terminal fittings 19 located at the extreme ends of the electric wires 41. The electric wires 41 are housed by being bent so as to pass through the notched members 40 in the vicinity of the ribs 13 and to thereby be housed under the ribs 13. Further, the electric wires 41 are dropped in in a perfectly straight state along an area separate from the ribs 13. The chamfer protrusions 39 bite into the electric wires 41 inside the housing space 36 and thereby regulate the movement of the electric wires 41 in both axial direction and the direction of the diameter thereof.

Figure 11:
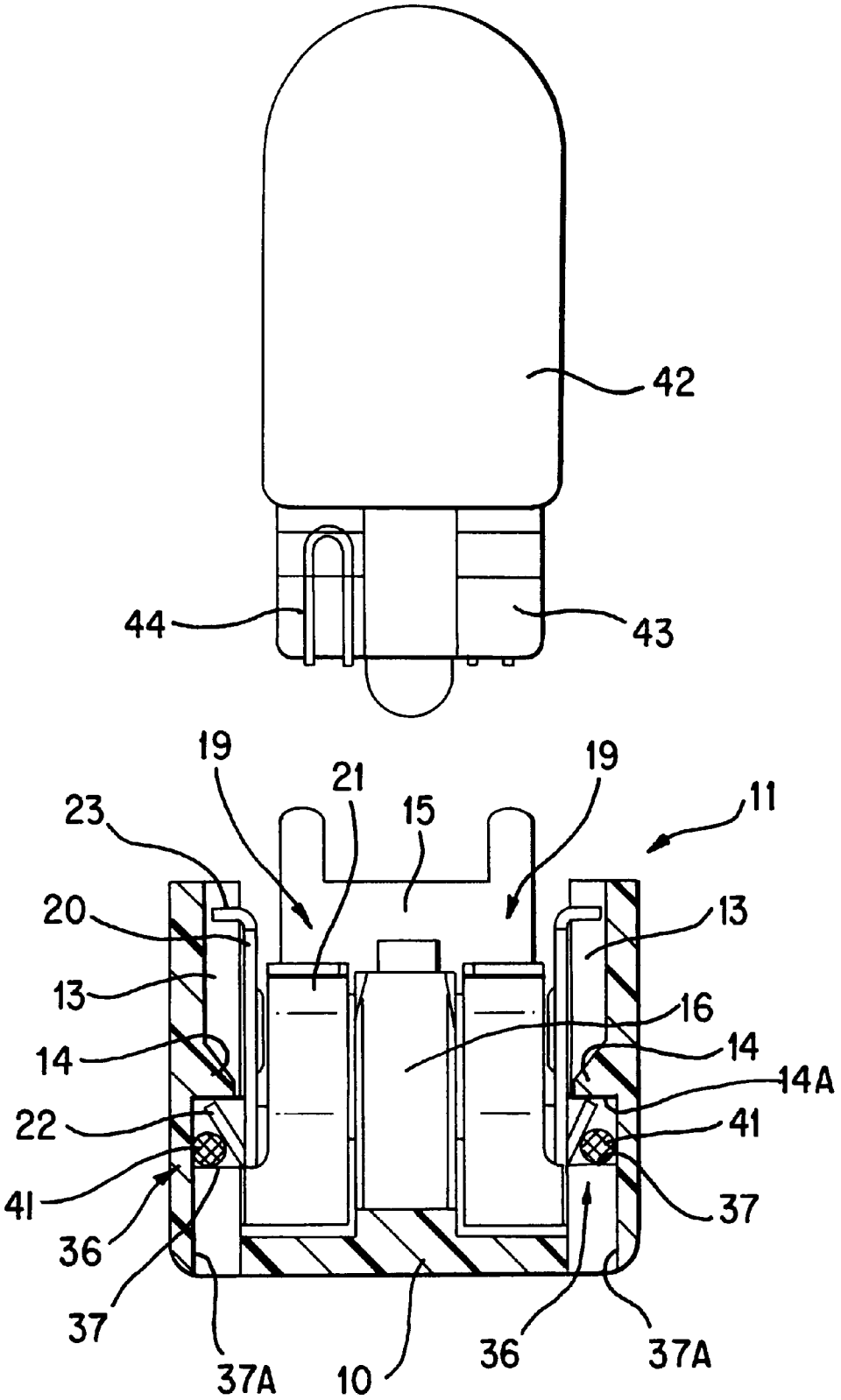
FIG. 11 is a cross-sectional view of FIG. 8 along the line Y—Y.
Figure 12:
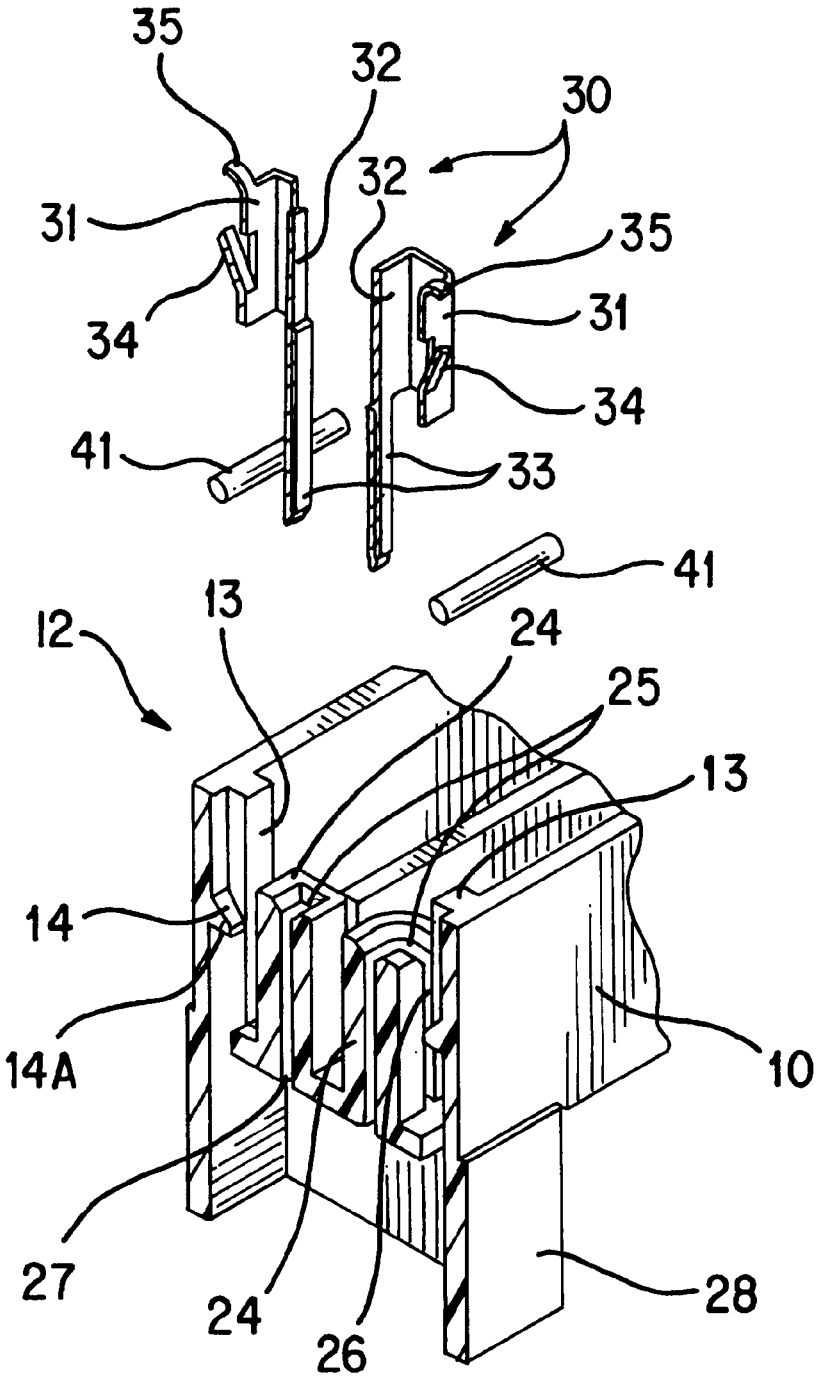
FIG. 12 is a partially cut-away diagonal view showing a connector member and a connector terminal fitting in a separated state.
Figure 13:
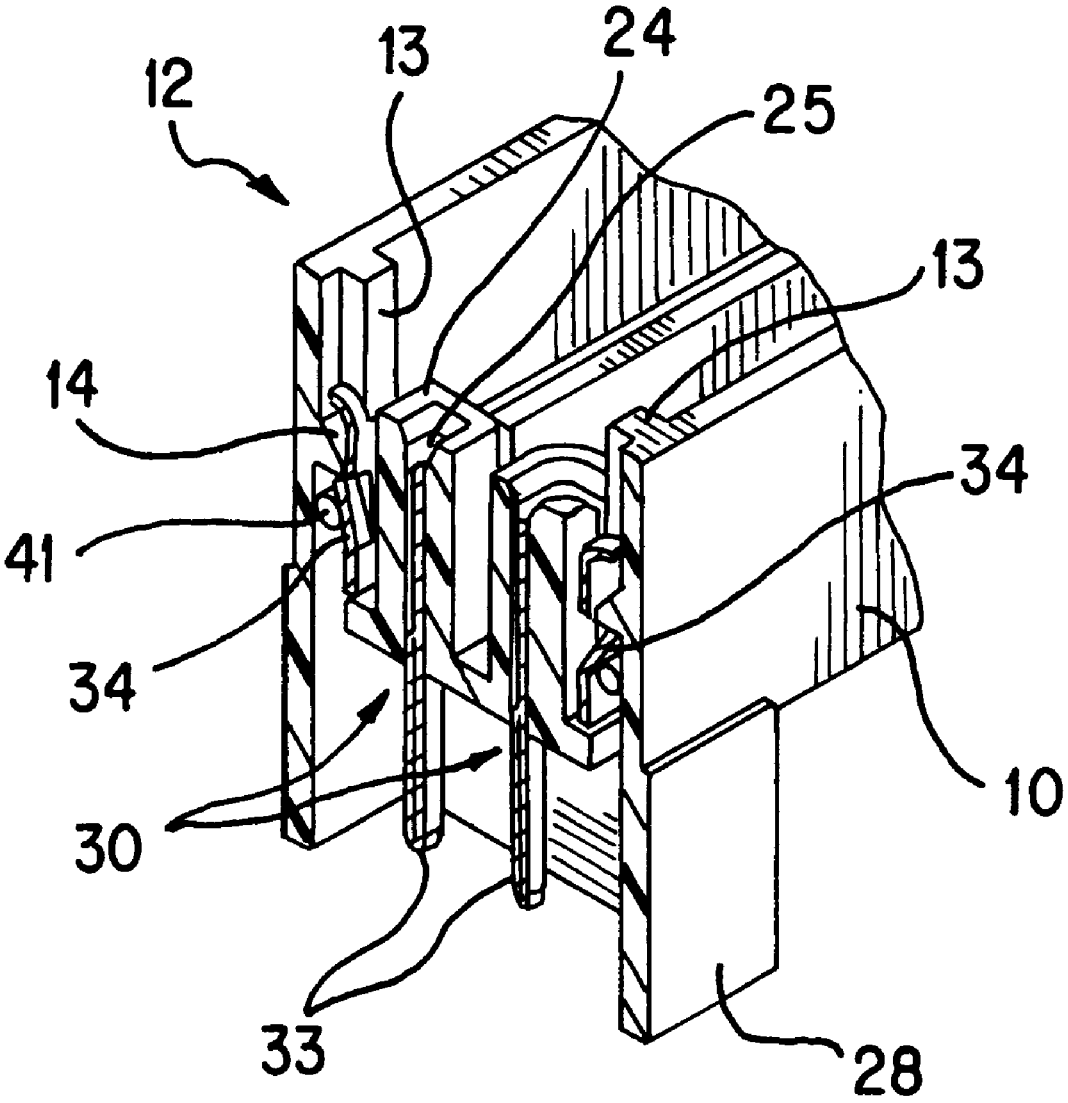
FIG. 13 is a partially cut-away diagonal view showing the connector terminal fitting in an attached state with the connector member.
Figure 14:
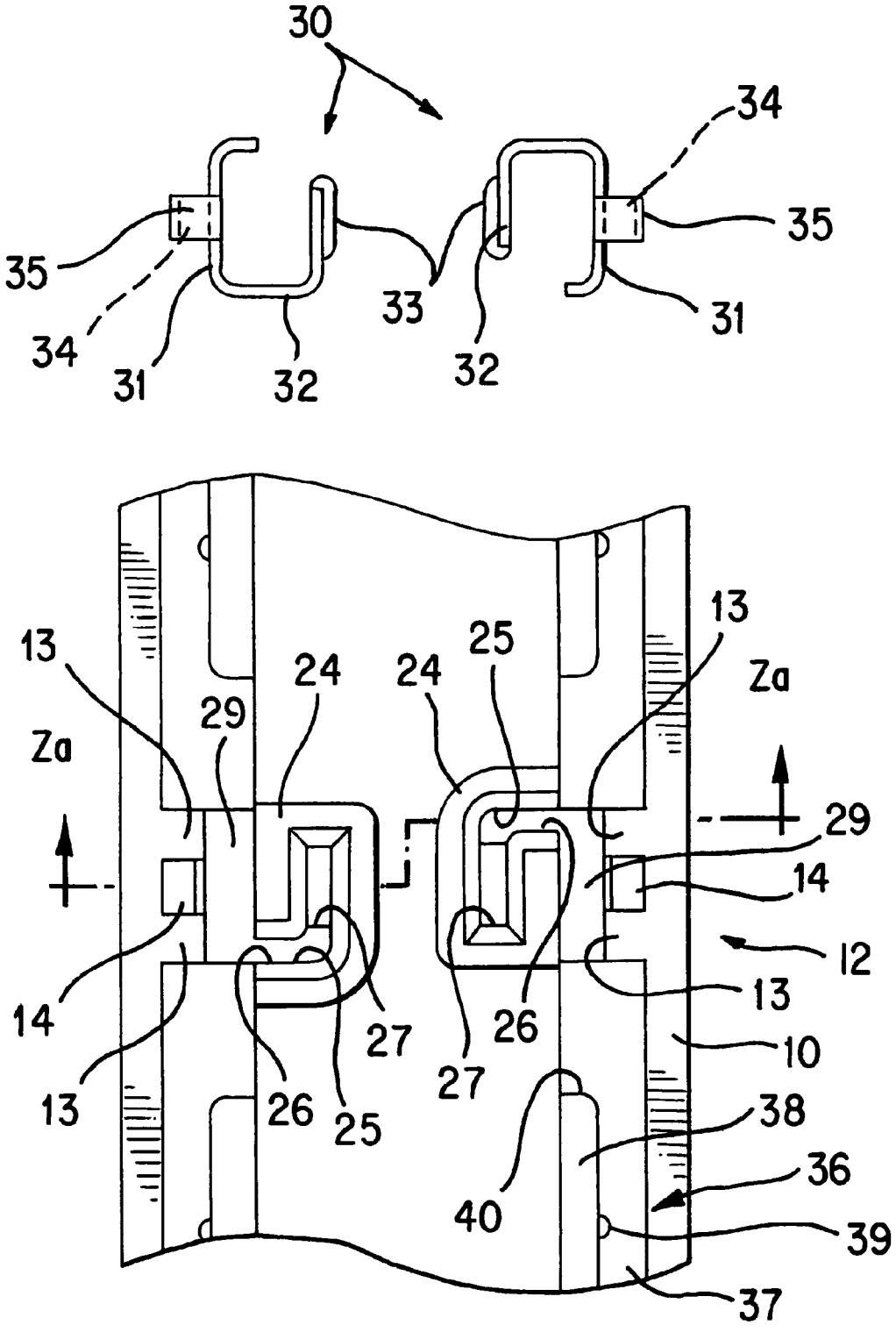
FIG. 14 is a plan view showing the connector member and the connector terminal fitting in a separated state.
Figure 15:
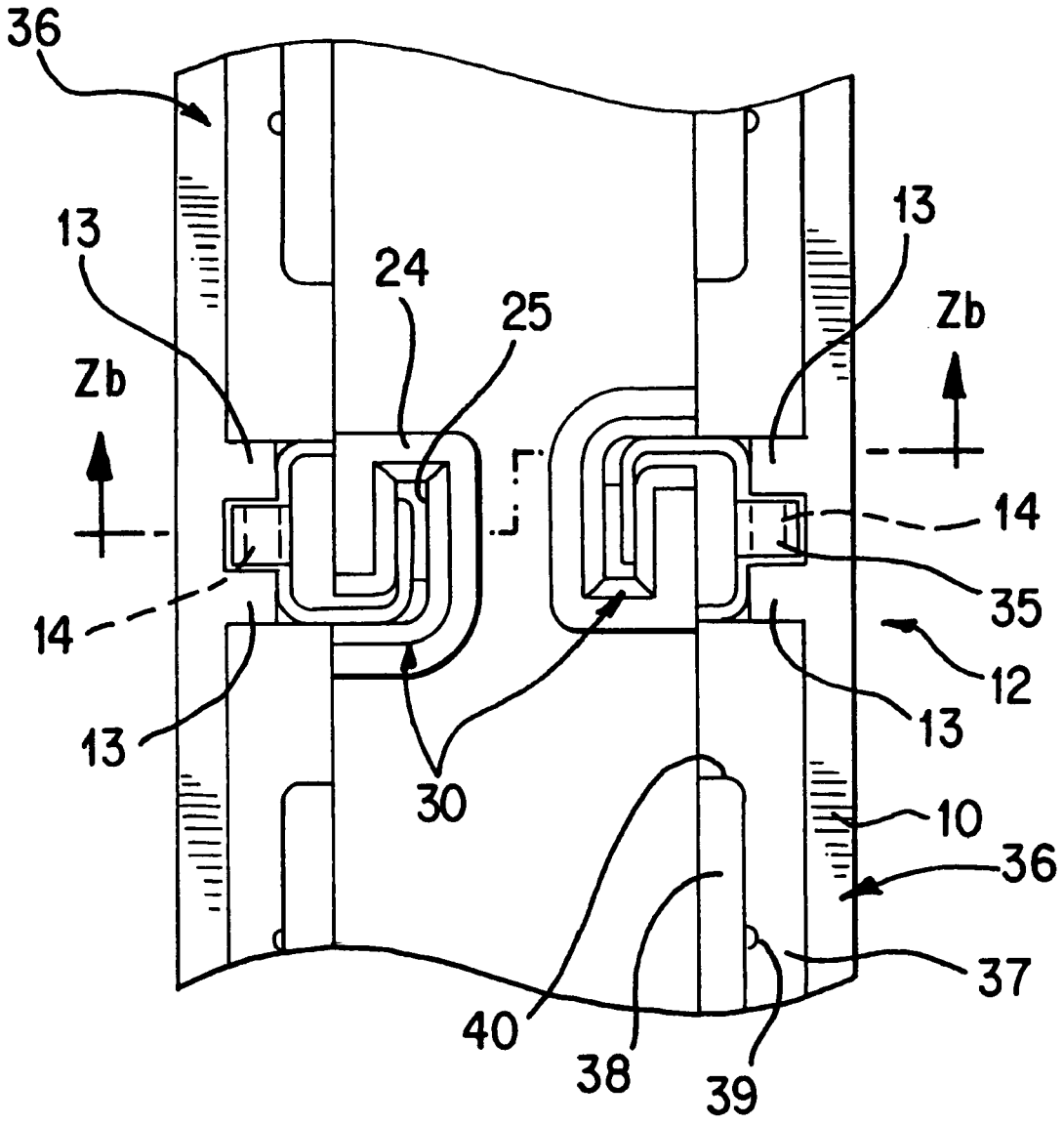
FIG. 15 is a plan view showing the connector terminal fitting in an attached state with the connector member.
Figure 16:
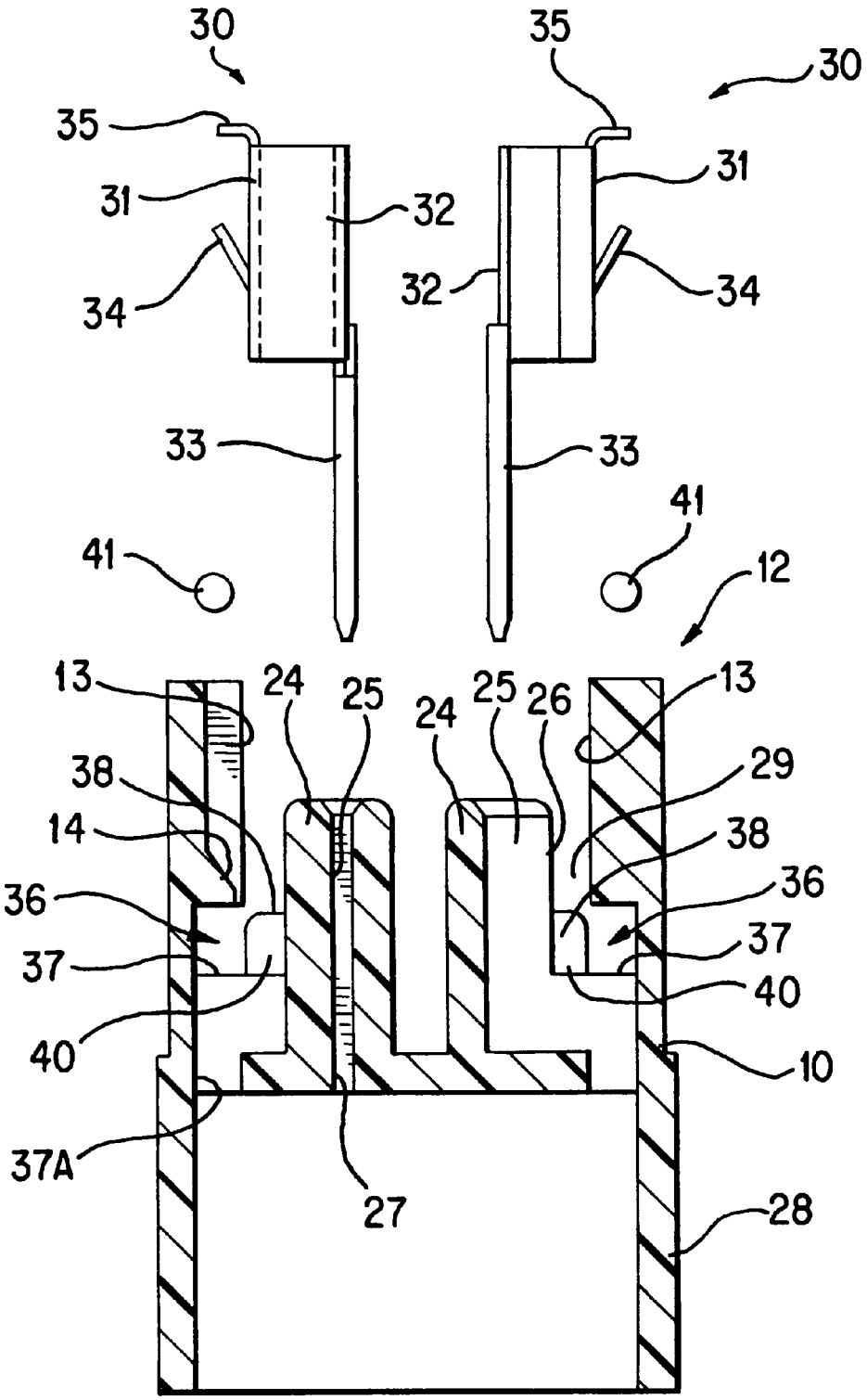
FIG. 16 is a cross-sectional view of FIG. 14 along the line Za—Za.
Figure 17:
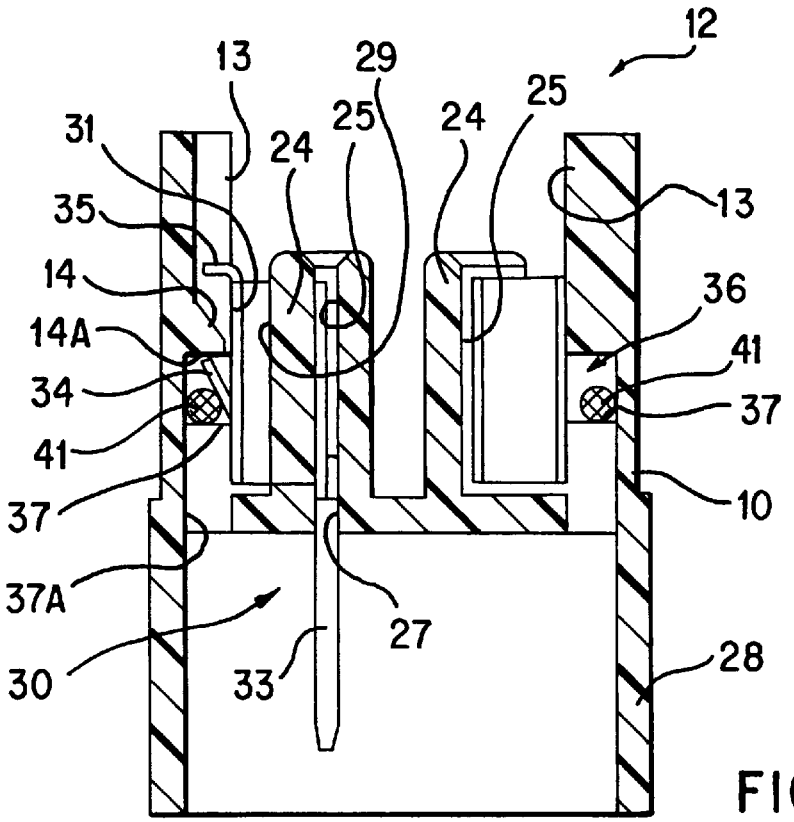
FIG. 17 is a cross-sectional view of FIG. 15 along the line Zb—Zb.

Next, the bulb terminal fittings 19 are attached to the terminal fitting attachment members 11, the connector terminal fittings 30 are attached to the connector member 12 and the bulb-linking contacting members 22 and 34 fit with the stopping protrusions 14, thereby retaining these bulb-linking contacting members 22 and 34. Then, as shown in FIGS. 11 and 17, the bulb-linking contacting members 22 and 34 make resilient contact with the electric wires 41, thereby linking all four of the feed terminal fittings 19 and 30 with one of the electric wires 41, and linking all four of the earth terminal fittings 19 and 30 with the other electric wire 41.

Furthermore, the spaces 37A are cut into the base wall face 37 of the housing space 36 within the region of contact of the bulb-linking contacting members 22 and 34 with the electric wires 41. However, these spaces 37A are the minimum area required. Moreover, the chamfer protrusions 39 also regulate the movement in an axial direction of the electric wires 41 within the housing space 36. As a result, the resilient pushing force of the bulb-linking contacting members 22 and 34 does not cause the electric wires 41 to bend greatly diagonally downwards, and therefore there is no reduction in the reliability of the contact between the electric wires 41 and the bulb-linking contacting members 22 and 34.

In this state the bulbs 42 are attached to the terminal fitting attachment members 11. The bulbs 42 then reach a conducting state with the bulb terminal fittings 19. When a corresponding connector attached to a battery (not shown) is attached to the connector member 12, the corresponding terminal fittings and the connector terminal fittings 30 reach a conducting state. In this manner, all three bulbs 42 can now be lit. In the embodiment as described above, the means to attach the bulbs 42 mutually together, and the means to attach the bulbs 42 to the connector member 12, are the bulb terminal fittings 19 which make contact with each bulb 42 and the connector terminal fittings 30 provided within the connector member 12. The electric wires 41 link these terminal fittings 19 and 30 together, the electric wires 41 thereby being the attachment means, and thus the electric wires 41 do not require terminal areas making contact with the bulbs 42, nor are terminal areas required in the connector member 12.

As a result, if a plurality of types of multiple-light lighting fixtures are produced which have varying numbers of bulbs 42 or varying orientation pitches, individual lamp holders 10 which correspond to the number of bulbs or the orientation pitch need not be produced. Instead, the bulb terminal fittings 19 and the connector terminal fittings 30 are attached, and the electric wire 41, which has previously been formed having a prescribed length, is cut to the length required, and then attached. This is advantageous, in terms of component simplicity and cost, compared to the case where a bus bar (equivalent to the electric wires 41) has a plurality of terminal areas formed in a unified manner, these corresponding to the bulbs 42, and a plurality of types of bus bars being produced in order to correspond to the number of bulbs 42 and the orientation pitch.

Furthermore, the bulb-linking contacting members 22 and 34 make resilient contact with the electric wires 41. As a result, these bulb-linking contacting members 22 and 34 maintain an adequate contacting force, and the reliability of the contact is thereby increased.

Moreover, the bulb-linking contacting members 22 and 34, which serve as components to the link electric wires 41 with the terminal fittings 19 and 30, also serve the function of retaining the terminal fittings 19 and 30. As a result, the configuration of the lamp holder 10 and the terminal fittings 19 and 30 is simpler than the case in which bulb-linking contacting members and stopping lances are provided separately.

Figure 18:
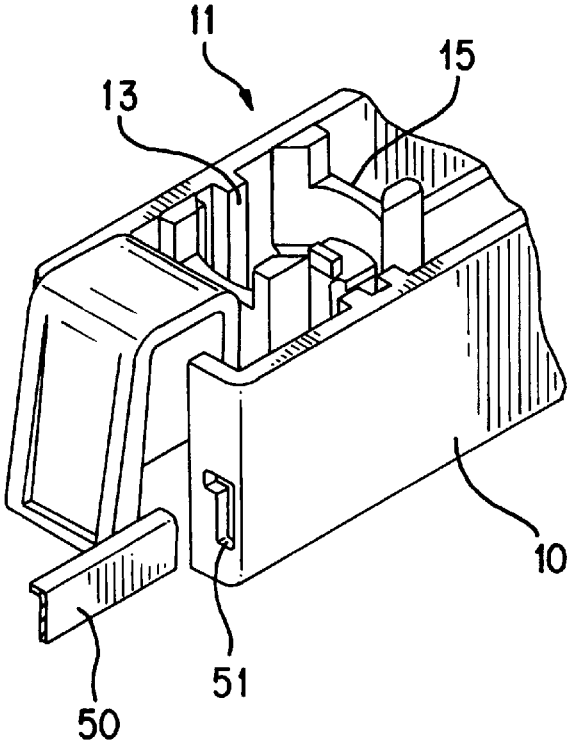
FIG. 18 is a diagonal view of a second embodiment.
Figure 19:
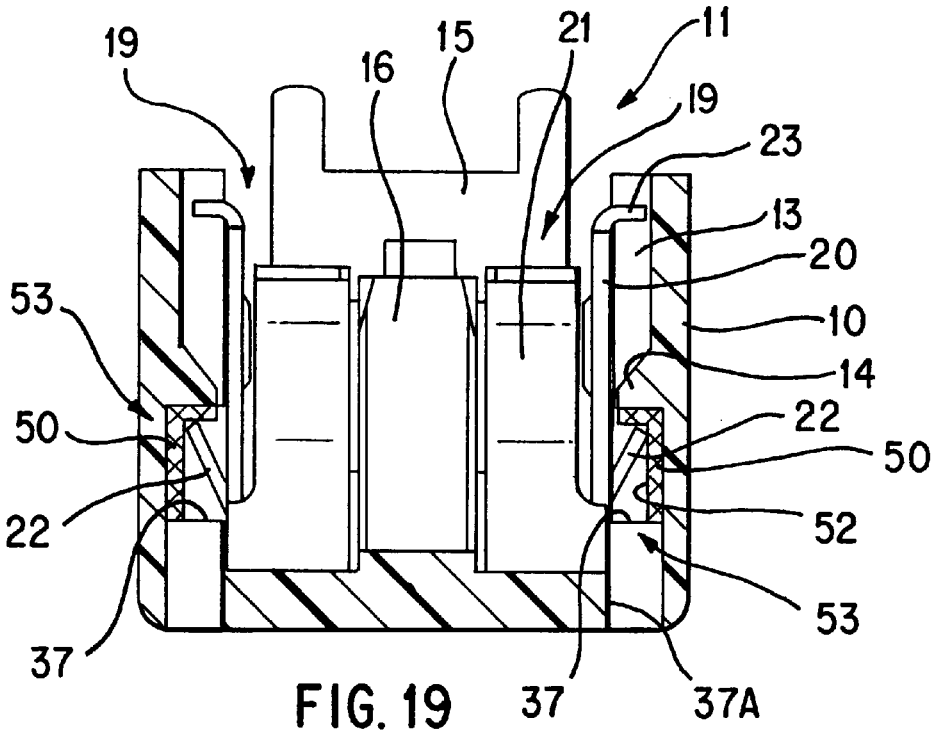
FIG. 19 is a cross-sectional view of the second embodiment.

Next, a second embodiment of the invention will be explained with the aid of FIGS. 18 and 19. Bulb connecting members of embodiment 2 have a different configuration than those of embodiment 1. The configuration of the other parts is the same as in embodiment 1, and therefore the same numbers are accorded to the parts having the same configuration as embodiment 1, and an explanation thereof is omitted. Bulb connecting members 50 of the second embodiment are formed by bending a metal plate into an L-shaped angle member. An insertion hole 51 opens onto either the right or left external end face of the lamp holder 10 and passes through to a housing space 53. The bulb connecting members 50 are inserted into the housing space 53 via this insertion hole 51 and are attached therein in a state whereby they make contact with inner wall faces 52 of the lamp holder 10 and with the lower faces of the ribs 13. In this state, the bulb terminal fittings 19 are attached, the bulb-linking contacting members 22 thereof make resilient contact with the bulb connecting members 50, the bulbs 42 thereby reaching a connected state.

Figure 20:
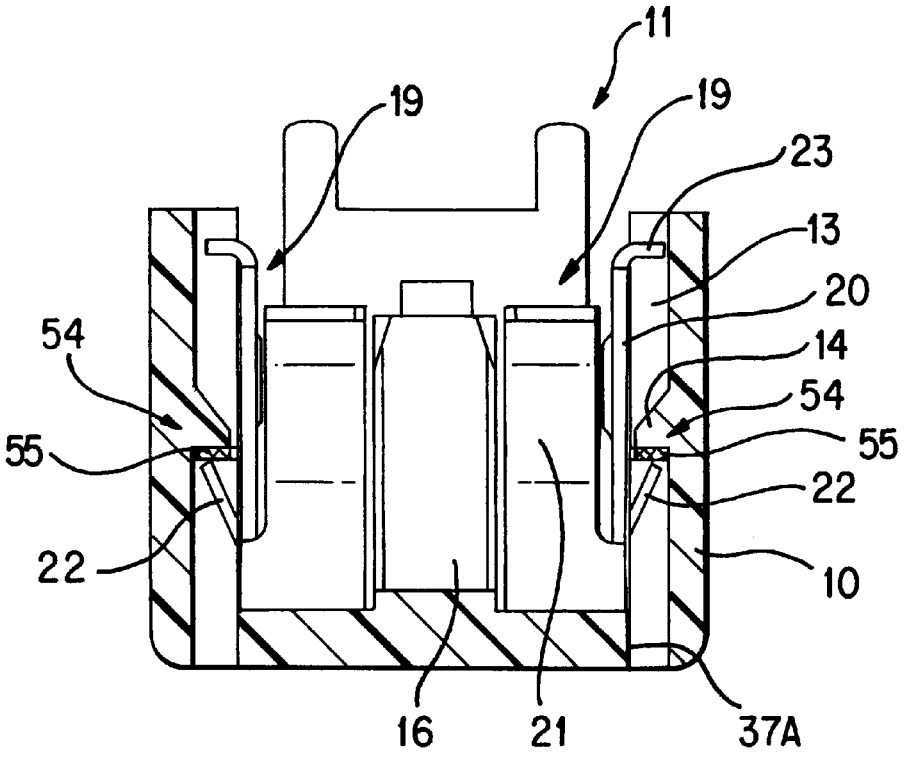
FIG. 20 is a cross-sectional view of a third embodiment.

A third embodiment of the present invention will be explained with the aid of FIG. 20. Bulb connecting members 55 of embodiment 3 are horizontal and have a long, thin, and narrow plate shape. The height of housing spaces 54 is approximately the same as the plane thickness of the bulb connecting members 55. The bulb connecting members 55 are attached in a state whereby they make contact with the lower faces of the ribs 13, and the tips of the bulb-linking contacting members 22 make contact with the lower faces of the bulb connecting members 55.

Figure 21:
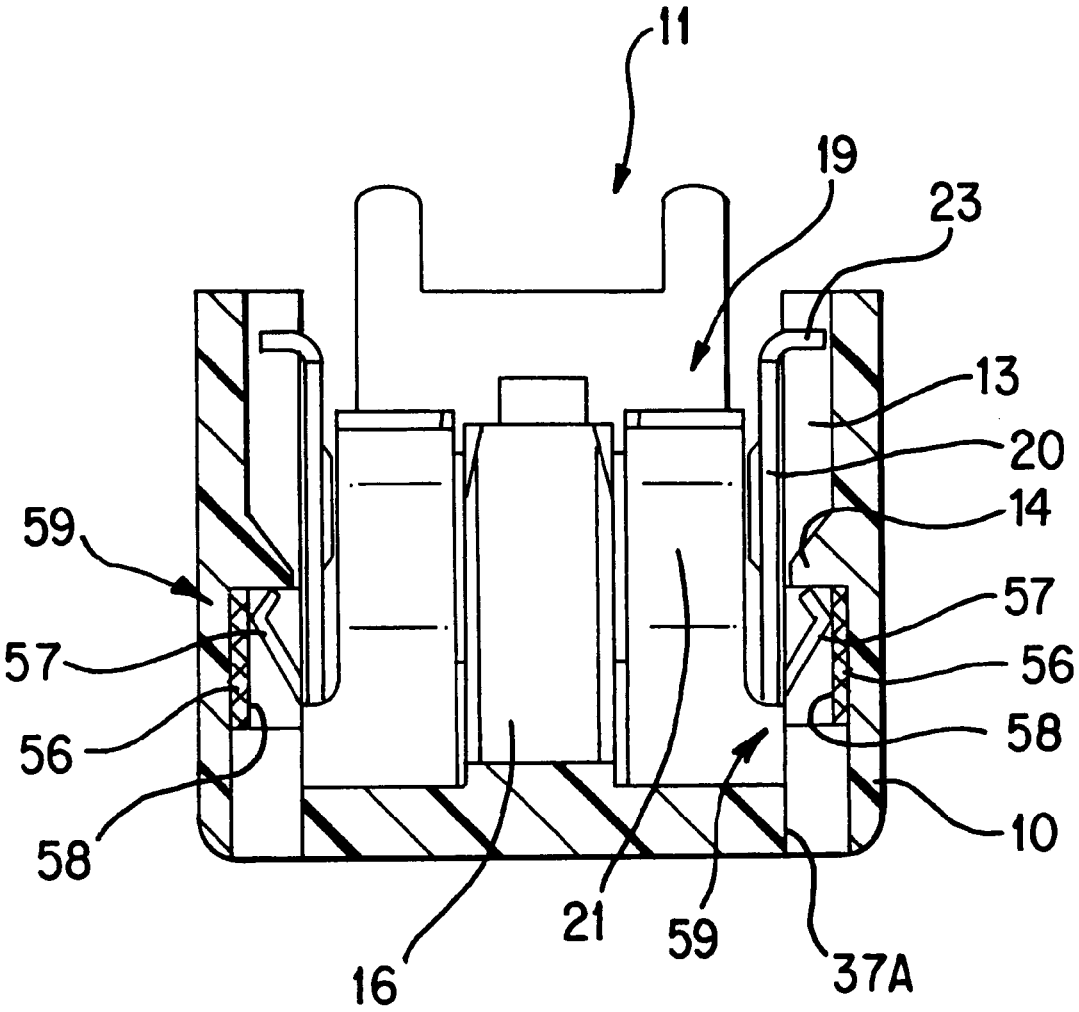
FIG. 21 is a cross-sectional view of a fourth embodiment.
Figure 22:
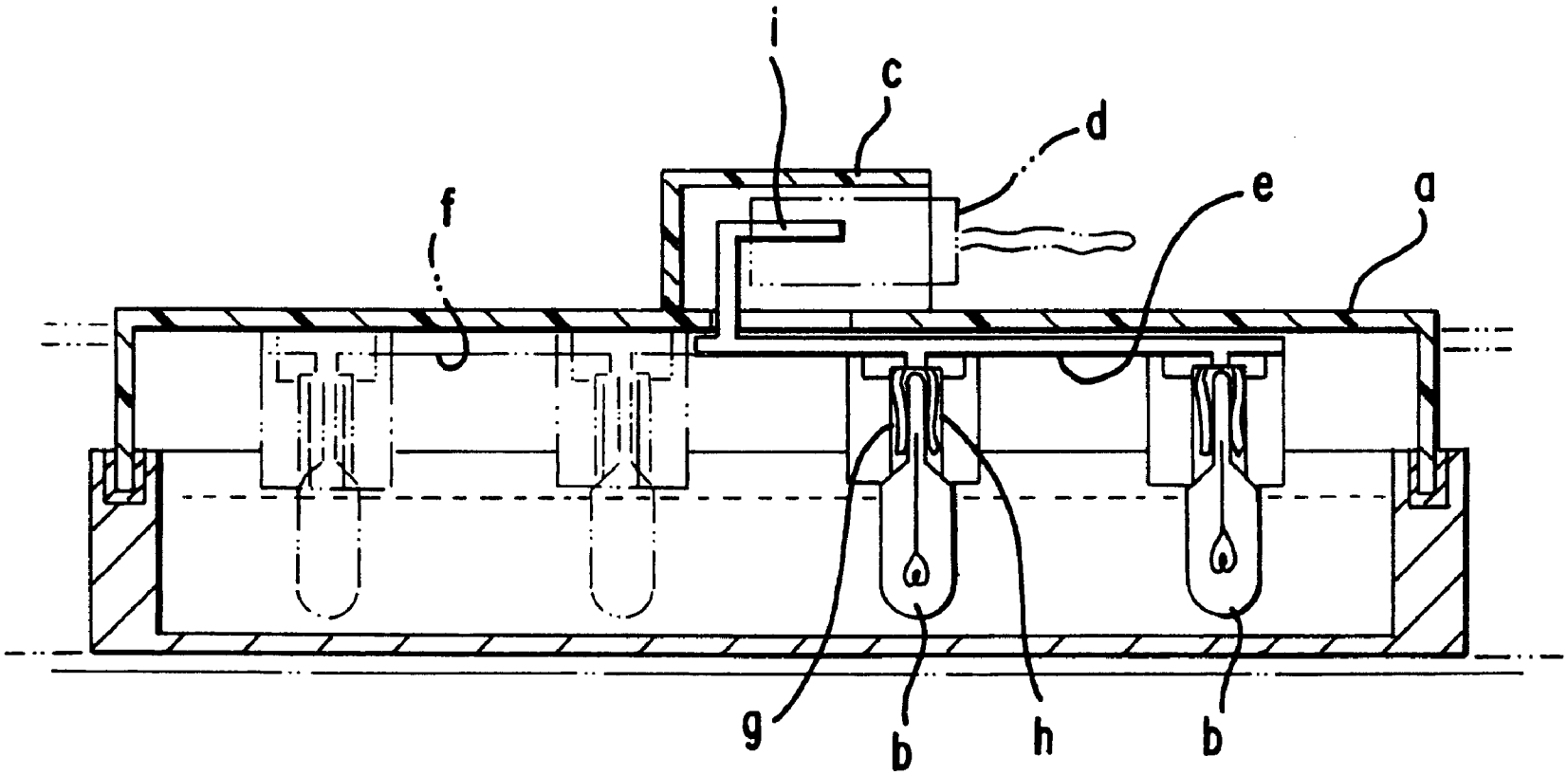
FIG. 22 PRIOR ART
FIG. 22 is a cross-sectional view of a prior art example.

A fourth embodiment of the present invention will be explained with the aid of FIG. 21. Bulb connecting members 56 of embodiment 4 are attached within a housing space 59 in a manner whereby these bulb connecting members 56 extend along inner wall faces 58 of the lamp holder 10. The bulb connecting members 56 are inserted into the housing space 59 via an insertion hole (not shown) provided on either the left or right edge of the housing space 59, the inserting tips thereof fitting together with a receiving groove (not shown) provided in the side opposite the insertion hole of the housing space 59. The bulb connecting members 56 are supported at both ends by the insertion hole and the receiving groove and they are thereby maintained in a position extending along the inner wall faces 58 of the lamp holder 10. Bulb-linking contacting members 57 of bulb terminal fittings 19 face diagonally upwards and outwards, the tips thereof being bent diagonally upwards and inwards outer faces of these bent portions making resilient contact with the bulb connecting member 56.

The present invention is not limited to the embodiment described above with the aid of figures. For example, the possibilities described below also lie within the technical range of the present invention. In addition, the present invention may be embodied in various other ways without deviating from the scope thereof.

(1) In the above embodiments the lances for stopping the terminal fittings also function as the bulb-linking contacting members. However, according to the present invention, bulb-linking contacting members could equally be provided separately from the lances.

(2) In the above embodiments, the bulb-linking contacting members are formed in a unified manner in the terminal fittings. However, according to the present invention, the bulb-linking contacting members could be formed separately and then attached to the terminal fittings.

(3) In embodiment 1, the plastic cover of the electric wires is removed along the entire length thereof, leaving the leading wire exposed. However, it is also possible that this wire be exposed only along the portion of the terminal fittings and the bulb-linking contacting members.

(4) In the above embodiments, the bulb connecting members are housed within a housing space. However, according to the present invention, the bulb connecting members may also be attached in a state whereby they protrude on the outer face of the lamp holder.

(5) In the above embodiments, the bulb connecting members are attached in a parallel manner with the bulb terminal fittings and the connector terminal fittings. However, a series connection of the bulb terminal fittings with the connector terminal fittings is also suitable for the present invention.

What is claimed is:

1. A multiple lamp fixture for receiving a plurality of aligned lamp bulbs, the lamp fixture comprising a lamp holder, a plurality of electrical conductors positioned within said lamp holder, each said conductor having a generally uniform configuration along its length, an electrical connector associated with the electrical conductors, a plurality of attachment members unitarily formed on a surface of the lamp holder, a plurality of electrically conductive terminal fittings associated with each of said attachment members, each terminal fitting having a contact that electrically couples the fitting to one of the conductors and secures the fitting to one of the attachment members on the lamp holder.

2. A fixture according to claim 1 wherein each of said contacts comprises a resilient arm.

3. A fixture according to claim 1 wherein said attachment member comprises a recess into which said terminal fittings are inserted, and the contact of each of said terminal fittings extends upwardly and outwardly of the recess.

4. A fixture according to claim 3 wherein each said contact is a latch that engages said attachment member.

5. A fixture according to claim 2 wherein said attachment member comprises a recess into which said terminal fittings are inserted, the resilient arm contact of each of said terminal fittings extends upwardly and outwardly of the recess.

6. A fixture according to claim 4 wherein each said resilient arm is a latch that engages said attachment member.

7. A fixture according to claim 1 wherein said lamp holder includes a channel having said attachment members spaced longitudinally therein, and the electrical conductors extend longitudinally along either side of said channel for respective connection to said contacts.

8. A fixture according to claim 7 wherein said electrical conductors lie between a base of said channel and said contacts.

9. A fixture according to claim 1 wherein each of said contacts is formed of a single sheet metal piece.

10. A fixture according to claim 1 wherein the electrical connector includes a connector terminal fitting adapted to fit to an insertion space of the lamp holder.

11. A fixture according to claim 10 wherein the terminal fitting has an elongate tab which, in use, extends through the insertion space and projects from a rear face of the lamp holder.

12. A fixture according to claim 10 wherein each contact for connection to the respective electrical conductors of the connector is a resilient member.

13. A fixture according to claim 12 wherein the terminal fitting has an elongate tab which, in use, extends through the insertion space and projects from a rear face of the lamp holder.

* * * * *

UNITED STATES PATENT AND TRADEMARK OFFICE

CERTIFICATE OF CORRECTION

PATENT NO. : 6,343,942 B1
DATED : February 5, 2002
INVENTOR(S) : Masaki Okamoto

It is certified that error appears in the above-identified patent and that said Letters Patent is hereby corrected as shown below:

Title page,
ABSTRACT, line 2, replace "bulb-inking" with -- bulb-linking --.

Signed and Sealed this

Twenty-eighth Day of May, 2002

*Attest:*

*Attesting Officer*

JAMES E. ROGAN
*Director of the United States Patent and Trademark Office*